United States Patent [19]

Shader et al.

[11] Patent Number: 4,660,814

[45] Date of Patent: Apr. 28, 1987

[54] NEEDLECRAFT STAND

[76] Inventors: William C. Shader; Doris L. Shader, Box 125, R.D.-1, Avella, Pa. 15312

[21] Appl. No.: 495,926

[22] Filed: May 23, 1983

Related U.S. Application Data

[63] Continuation of Ser. No. 239,649, Mar. 2, 1981, abandoned.

[51] Int. Cl.[4] ..... D05C 1/02

[52] U.S. Cl. ..... 269/16; 269/71; 269/82; 269/160; 269/909; 38/102.2; 223/106

[58] Field of Search ..... 38/102.2, 102.1; 223/106; 248/122, 397, 184, 447; 160/378; 289/1.5, 18.1; D15/66; 269/221, 222, 223, 71, 82, 45, 16, 160, 265, 909

[56] References Cited

U.S. PATENT DOCUMENTS

| | | | |
|---|---|---|---|
| D. 244,755 | 6/1977 | Bard | 38/102.2 X |
| 406,119 | 7/1889 | White | 38/102.2 |
| 874,435 | 12/1907 | Prescott | 248/397 |
| 1,192,267 | 7/1916 | Bond | 269/71 |
| 1,910,934 | 5/1933 | Segal | 248/457 |
| 1,954,548 | 4/1934 | Thrasher | 269/221 X |
| 2,019,789 | 11/1935 | Mahannah | 269/71 |
| 2,025,172 | 12/1935 | Martin | 248/122 |
| 2,489,547 | 11/1949 | Temple | 269/160 |
| 3,899,164 | 8/1975 | Newman | 269/82 X |
| 3,906,648 | 9/1975 | Bard | 38/102.2 |
| 3,955,722 | 5/1976 | Bard | 223/106 |
| 4,167,264 | 9/1979 | Kretzmeir | 269/16 |
| 4,292,748 | 10/1981 | Miller | 38/102.2 X |

*Primary Examiner*—Frederick R. Schmidt
*Assistant Examiner*—Steven P. Schad

[57] ABSTRACT

A needlecraft stand for supporting a needlecraft frame in convenient position for use by someone sitting in a chair or other seat and which may be easily adjusted by the user. The stand has a flat base, a pivotable post extending upwardly from the base and a clamp for holding a needlecraft frame pivotably attached to the top of the post. A hinge is provided between the clamp and the top pivot connection to permit tipping the needlecraft work upwardly to provide convenient access to the underside of the work.

6 Claims, 9 Drawing Figures

NEEDLECRAFT STAND

This application is a continuation of application Ser. No. 239,649, filed Mar. 2, 1981, abandoned.

BACKGROUND OF THE INVENTION

1. Field of Art

This invention relates to a stand for needlecraft frames and in particular to an adjustable stand for supporting a needlecraft frame in position for convenient access and work by the user.

2. Brief Description of the Prior Art

Millions of people all over the world do various types of needlework such as needlepoint, cross-stitch and embroidery. Most such work involves the use of a frame for holding the cloth material flat for applying the stitching to it. The frame may be held in the user's lap or may be held by a stand or support so as to free the user's hands to work the needle.

A variety of stands has been used for needlecraft frames as disclosed in the patent art. For example, U.S. Pat. No. 3,899,164 to Newman discloses an adjustable floor support for needlecraft frames which includes a pair of vertically extending legs supported by a longitudinally adjustable cross member with each of the legs having a knee joint for pivoting of an upper portion of the leg. The support includes a mouth clamp on each leg for clamping a needlecraft frame on the support. Newman's support can be adjusted to receive frames of varying sizes and to permit locating the frames for access by a person sitting at a chair or couch.

U.S. Pat. No. 4,175,343 discloses a needlework stand comprising a flat base, a post extending vertically from the center of the base, an elongated bar with a plurality of openings in it for attaching needlework frames of various sizes and a support means which includes means for adjusting the height and angle of disposition of the needlework frame.

U.S. Pat. No. 1,910,934 discloses an embroidery frame having a pair of feet and uprights, a spreader bar between the feet and a working frame pivotably supported on the uprights.

U.S. Pat. No. 1,275,929 discloses an embroidery frame which has a single post on which the frame is pivotably mounted. The post is held upright by legs which support the post in its vertical position. Other stands and display fixtures of incidental interest are disclosed in U.S. Pat. Nos. 884,670; 1,270,004; 2,156,367; 3,738,606 and 4,165,856.

SUMMARY OF INVENTION

This invention provides a needlework stand for supporting needlecraft work which is readily portable and adjustable for different sizes and shapes of needlework frames and for an infinite variety of positions and heights. The stand includes a post which projects upwardly from a flat base and a clamp for holding a needlecraft frame connected to the top of the post by a friction pivot connection. There is also a friction pivot connection between the post and the base, which in combination with the pivot connection between the post and clamp, permits adjustment of the height and lateral position of the work with respect to the base. The stand further has a hinge between the clamp and the top pivot to permit tipping the work upwardly approximately 90° for convenient access to the underside of the needlecraft work.

Accordingly, an object of this invention is to provide a portable needlework stand which will conveniently support the work for use by someone seated at a chair, couch, bed, car seat or the like.

A further object is to provide a needlework stand that is extremely versatile in the size and shape of frames it will support and the positions in which the frames can be supported.

A further object is to provide a needlework stand that can be easily folded to a flat condition for storage and/or transport and to display the work in the home.

Another object of this invention is to provide a needlecraft stand which permits ready and convenient access to the underside of the work.

The above and other objects and advantages of this invention will be more fully understood by reference to the following description and the drawings included herewith.

DESCRIPTION OF A PREFERRED EMBODIMENT

Figure 1:
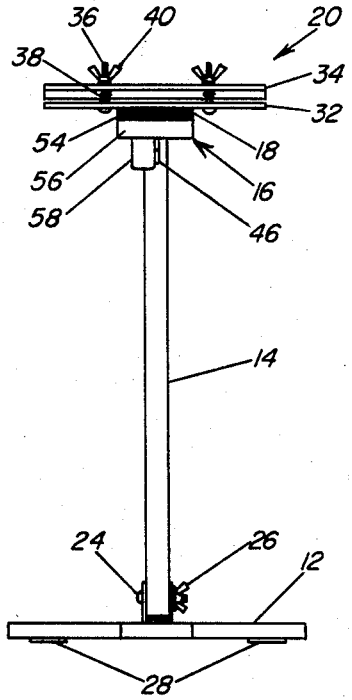
FIG. 1 is a front elevation of a needlecraft stand of this invention.

Referring to the drawings, a preferred embodiment of a needlecraft stand 10 of this invention is illustrated as including a generally flat base 12, a post 14 mounted on the base, a gooseneck bracket 16 on the top of the post, a hinge 18 mounted on the bracket and a clamp 20 secured to one leg of the hinge. The post 14 is mounted on the base 12 through a U-bracket 22 which is attached to the base as with screws or bolts, not shown. The post 14 is pivotably secured in the bracket 22 by a carriage bolt 24 which is disposed through holes in the bracket and post. A wing nut 26 secures the bolt in place and provides the necessary tension in the bolt 24 to press the sides of the bracket against the post to hold the post in the desired position. Friction washers made of sandpaper or the like, not shown, may be provided at the interfaces between the bracket and post for increasing the friction therebetween to hold the post in a desired position. Once the tension between the wing nut 26 and bolt 24 is properly set, it shouldn't be necessary to adjust the tension to pivot the post to any desired angle thereof. However, the friction at the pivot connection can be easily adjusted, if necessary, by tightening or loosening the wing nut 26 on bolt 24.

Figure 5:
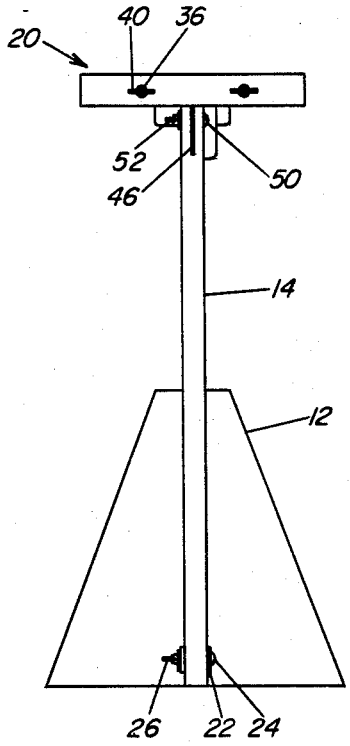

The base 12 is generally flat so it can fit under a chair, car seat, bed or couch and for flat storage of the folded stand. Two small pads 28 may be secured on the bottom of the base 12 along the edge under the post 14 to stabilize the stand on an uneven floor surface. As seen in FIG. 5, the base 12 may be trapezoidal in plan, or may be rectangular, triangular or other pleasing configuration. The bracket 22 and post 14 are mounted on the base near one edge of the base on its centerline. The carriage bolt 24 is disposed transverse to the centerline of the base so the post 14 pivots upwardly in a vertical plane through such centerline.

Figure 2:
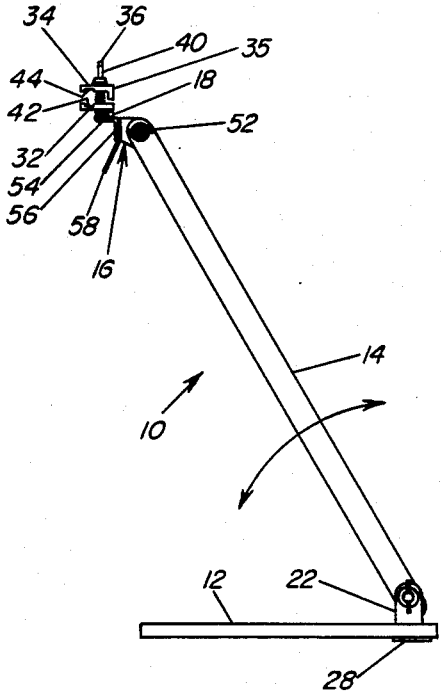
FIG. 2 is a side elevation of the stand of FIG. 1.

The clamp 20 comprises two jaws 32 and 34 with two carriage bolts 36 disposed through holes in the jaws. Coil springs 38 are positioned on the bolts 36 between the jaws 32, 34, and wing nuts 40 are threaded on the ends of the carriage bolts as they project upwardly from the jaws as seen in FIGS. 1 and 2. The upper jaw 34 is preferably L-shaped as seen in FIG. 2 so the clamping force will be greatest along the edges of the jaws and which are open toward the user. The jaws also preferably have opposed longitudinal grooves 42 and 44 cut in them to further enhance their ability to tightly grip a needlecraft frame without damage to the frame or needlework on the frame.

The base 12, post 14 and jaws 32, 34 of the clamp 20 are preferably formed from hardwood and should be sanded smooth and finish coated to give the stand an attractive appearance. The base may also be made from pressed board with a hardwood veneer on both faces. Typical dimensions for a needlecraft stand of this invention would be a base $\frac{3}{4}$-inch thick, with its parallel edges 16 inches and 4 inches long and 16 inches between the parallel edges. The post 14 may be approximately 30 inches long and $1\frac{1}{4}$ inches by $1\frac{1}{2}$ inches in cross section with the greater thickness being the thickness which is seen from the side as in FIGS. 2–4. The jaws 32, 34 of the clamp may be 12 to 14 inches long, $1\frac{3}{4}$ inches wide and $\frac{3}{8}$-inch thick.

The top end of the post 24 has a longitudinal slot 46 cut in it (FIG. 5) for receiving blade portion 48 of gooseneck bracket 16 and has a hole therethrough transverse to the slot to receive a carriage bolt 50 for securing the gooseneck bracket on the post. A wing nut 52 permits convenient adjustment of the tightness of the connection for a desired pivoting of the bracket with respect to the post. Friction washers, not shown, may be used if desired to provide additional friction in the pivot joint. The two carriage bolts 24 and 50 are parallel so that the top and bottom pivot connections will cause the post 14 and gooseneck bracket 16 to pivot in parallel planes as will be explained.

Figure 3:
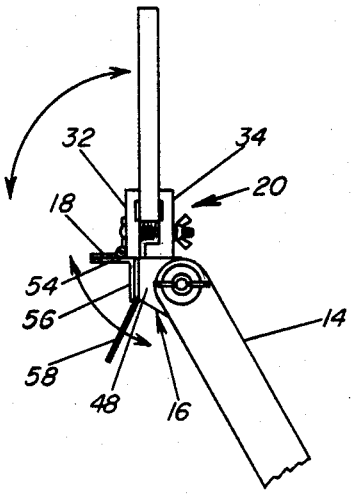
FIG. 3 is a fragmentary side elevation of the stand of FIGS. 1 and 2 showing a needlepoint frame secured in the clamp on the stand with the clamp and frame hinged back for access to the underside of the work.
Figure 4:
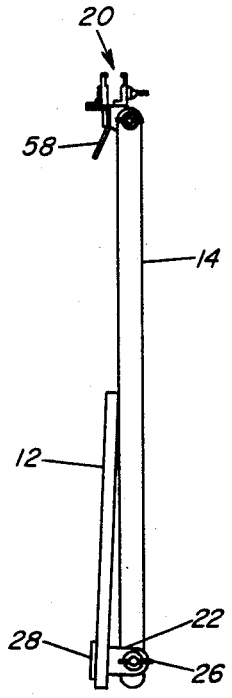
FIGS. 4 and 5 show the stand in folded condition for storage and transport.

The gooseneck bracket 16 includes two flanges 54 and 56 in the form of an "L" which is connected to the blade portion 48 and has a small handle 58 projecting from flange 56 to facilitate pivoting of the bracket with respect to the post 14. One leg of the hinge 18 is permanently secured as by rivets or welds to flange 54 of the bracket and the other leg of the hinge is secured as by screws or rivets to the clamp 20. The hinge 18 is attached to the bracket 16 and clamp 20 so as to permit tipping the clamp upwardly approximately 90° as seen in FIG. 3. The hinge pivot is disposed parallel to the longitudinal axis of the flanges 54 and 56 of the bracket 16 and carriage bolts 24 and 50 with the hinge opening away from the pivot connection at the top of the post.

The brackets 16 and 22 and hinge 18 are preferably made of aluminum which can be anodized to vary its colors and improve the appearance of the brackets. The gooseneck bracket 16 and handle 58 may be fabricated from two or three separate pieces as illustrated or could be cast or formed in one piece if desired.

As illustrated in the drawings, the post 14 is designed to be pivoted up and down in a vertical plane through the centerline of the base and thus move the workpiece in an arc so the user can move the workpiece into convenient position over the user's lap when seated. The gooseneck bracket 16 is also pivoted about a friction joint which permits the user to adjust the angle and height of the workpiece depending on the angle of incline of the post. The carriage bolts 24 and 50 in the pivot connections are parallel so pivoting of the post 14 and gooseneck bracket 16 are also parallel. The flat base 12 will slide under a chair or car seat and the post can be positioned between the user's legs if desired. The carriage bolts 24, 50 and nuts 26, 52 on opposite ends of the post 14 can be adjusted to provide the necessary tension to hold the post and workpiece at the desired height and angle of incline. Adjustment of the gooseneck bracket 16 can be effected with one hand as can all the adjustments.

The hinge 18 permits convenient access to the underside of the work by merely tilting the work backward approximately 90° where the clamp will balance against the top of the gooseneck bracket or post as shown in FIG. 3 without need for the hands to hold it. This is a very desirable feature of a stand of this invention. In doing needlework, there is frequent need to have access to the underside of the work. It is therefore a tremendous advantage to be able to have such access merely by hinging the workpiece upward as is possible with a stand of this invention. Furthermore, the workpiece will stay in the raised position without need for support by the user. Depending on the angle of the post, it may be necessary to tilt the gooseneck bracket upwardly in order to balance the work in the position illustrated in FIG. 3, but this is a simple matter and can be done by merely lifting on the handle 58 on the gooseneck bracket 16. Since the hinge pivot is parallel to the carriage bolts 24 and 50, all three pivot connections will rotate or pivot the workpiece in parallel planes. The combined effect of all three pivots therefore facilitates locating the work in the most convenient position for the user.

Figure 6:
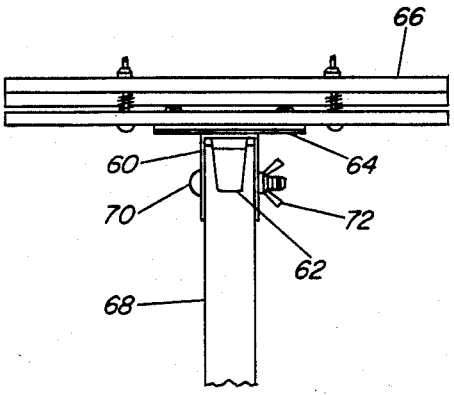
FIGS. 6, 7, 8 and 9 show two alternative embodiments of the pivot connection and handle at the top of the post in a stand of this invention.
Figure 7:
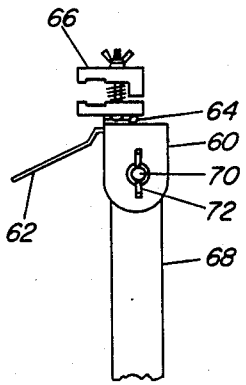

FIGS. 6 and 7 illustrate an alternative embodiment of this invention in which the gooseneck bracket 16 of FIGS. 1 through 5 has been replaced by a U-shaped bracket 60 having a handle 62 welded or riveted to the undersurface of the base of the bracket. The bracket 60 and handle 62 could also be formed in one piece. The handle 62 preferably projects downwardly from the plane of the base of the bracket at approximately a 45° angle for about $\frac{1}{2}$-inch and then at approximately a 30° angle to such plane for the remaining length of the handle (approximately two inches). One leg of a hinge 64 is welded or riveted to the top surface of the bracket 60 and a clamp 66 is riveted or otherwise attached to the other leg of the hinge as in the stand illustrated in FIGS. 1–5.

The post 68 in the embodiment of FIGS. 6 and 7 is the same as the post 14 in the first embodiment except the post 68 doesn't require a slot in it to receive the blade of a gooseneck bracket as in the first embodiment. Instead the U-shaped bracket 60 is mounted over the end of the post 68 with a carriage bolt 70 disposed through holes in the bracket and the post. A wing nut 72 secures the bolt in place under the desired tension to provide a friction joint. As in the first embodiment, the carriage bolt 70 is disposed parallel to the carriage bolt which holds the bottom end of the post in the bracket which is secured to the base of the stand. The base and bottom attachment are substantially identical in all the embodiments which have been selected for illustration. The hinge and clamp are also substantially identical in all the embodiments.

Figure 8:
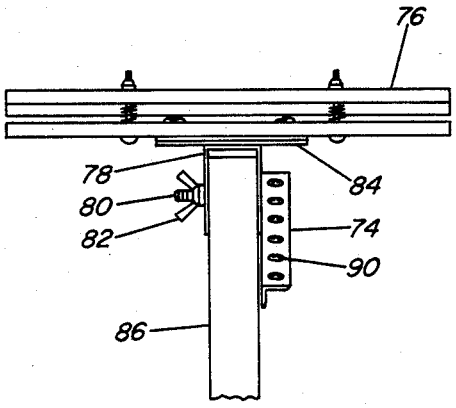
Figure 9:
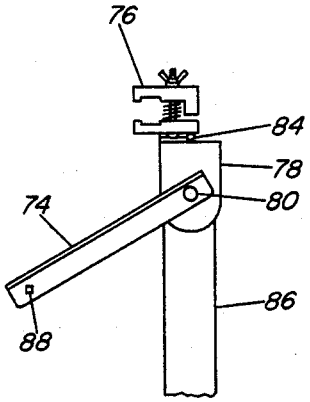

FIGS. 8 and 9 illustrate another embodiment of this invention similar to that of FIGS. 6 and 7 but having a modified handle 74 for adjusting the angle of the clamp 76 on the stand. The stand of FIGS. 8 and 9 employs a U-shaped bracket 78, carriage bolt 80 and wing nut 82 for mounting the hinge 84 and clamp 76 on the post 86. However, the handle 74 in this embodiment is a separate piece of metal (aluminum) in the form of an angle. The handle 74 has a square hole 88 in one or both ends thereof for receiving and mating with the square shoulder of the carriage bolt 80. The holes in the bracket 78 are also square for receiving and mating with the square shoulder on the carriage bolt. Consequently, raising and lowering of the handle 74 will rotate the carriage bolt 80 and pivot the bracket 78 and clamp 76 on the end of the post 86.

Since the shoulder on the standard carriage bolt of the size appropriate for use in a stand of this invention is only approximately 0.150 inch long, the sheet metal from which the handle 74 and bracket 78 are made for this embodiment should not be over approximately 0.080 inch thick so the shoulder on the carriage bolt will have a sufficient engagement with square holes in both the handle and the bracket. The angle form of the bracket provides more than adequate strength in relatively thin sheet metal.

Although not required, the provision of holes 88 in both ends of the handle 74 permits mounting of the handle on either side of the bracket 78 as will be apparent to those skilled in the art. The square holes in the bracket and angle are preferably oriented so the handle will be inclined downward approximately 30° with respect to the flat base of the bracket 78. This means that the handle will also be angled approximately 30° with respect to the planar workpiece secured in the clamp 76 which will provide more than adequate room for gripping the handle.

The handle 74 may also have one or more holes 90 in one leg of the angle to provide convenient storage of pieces of thread for subsequent application to the needlework. These holes can be easily punched in the sheet metal from which the handle is formed.

It is seen that this invention provides a needlecraft stand having many improved features. The stand is more readily portable and transportable which is important because of the desire of people who do needlework such as needlepoint, embroidery and cross-stitch to visit one another and work on their needlecraft in one another's company and also for convenient storage of the stand and needlework in the home. The stand folds up and can be easily stored or placed against a wall where it will display the piece being worked on.

Many different sizes and shapes of frames are used to secure the cloth in a firmly stretched position while creating attractive patterns in needlecrafts known as needlepoint, embroidery and cross-stitch. The needlecraft stand of this invention makes it possible to hold any of these various frames in the most advantageous position without any adjustment of the device. For instance, to change the work being done with a stand of this invention from a round 5-inch embroidery hoop $\frac{1}{2}$-inch thick to a 24-inch rectangular needlepoint frame $1\frac{1}{2}$ inches thick, no adjustment is required. All that is required is to simply remove the round 5-inch embroidery hoop from the clamp and secure the rectangular 24-inch needlepoint frame in the clamp by releasing and tightening the clamp thumb screws.

The frame clamp on a stand of this invention handles a wide range of frame thicknesses because of the position of the clamp screws in relation to the compensating lip 35 on the roar of the top clamp jaw and the fact that the top clamp screw holes are oversize allowing the clamp to function like jaws with a workable range from approximately $\frac{1}{4}$-inch to over $1\frac{7}{8}$ inches with the same 2-inch carriage bolt clamp screws. If work is to be held that measures more than $1\frac{7}{8}$ inches in thickness, 3 inches or longer carriage clamp bolts are easily substituted for the 2-inch bolts.

A stand of this invention is also extremely versatile. The single post design makes it practical to use the stand by placing it either beside or in front of a chair or sofa or bedside a bed and easily position the stand to hold the needlework in the most comfortable position.

A stand of this invention adjusts to an infinite variety of positions by simply overcoming the friction of one or both of the brackets which secure the post to the base and the clamp to the post. Friction at these points is created by the pressure of the wing nuts on the bolts through the post. Once the tension is selected on these wing nuts, it will stay properly adjusted almost indefinitely.

Working with a stand of this invention is made easy and fast because the clamp is connected to the top bracket with a hinge whereby the entire clamp and whatever type of frame is being held by the clamp can be tipped upwardly approximately 90° to a vertical position. This is desirable because each different piece of yarn or thread used in the work is secured on the back of the work.

A stand of this invention is also well suited for quick and easy assembly by the consumer and can be shipped and sold in an unassembled kit which is less expensive and more easily handled. Assembly of the kit is accomplished by even the novice and requires only a screwdriver.

What is claimed is:

1. A needlecraft stand comprising:

a generally flat base for disposition on a floor to support the stand, said base being symmetrical about a longitudinal axis;

a post connected to the base on the longitudinal axis of the base adjacent one edge of the base so a major portion of the base can fit under a seat, bed or the like;

a friction-type pivot connection in the post at its bottom end and having its pivot axis transverse to the longitudinal axis of said base so the post can be manually rotated up and down in a vertical plane through the longitudinal axis of the base;

a clamp having two parallel jaws for securing a needlecraft frame therebetween;

a bracket near the top of said post for securing said clamp to the post and connected to the post through a friction-type pivot connection having an axis parallel to the axis of the pivot connection in the post so the height and position of the clamp can be quickly and easily adjusted over the lap of a seated user, regardless of the position of the user;

a hinge connection between said bracket and said clamp with said hinge having a hinge pivot axis parallel to the pivot axes of said two friction-type connections; and said base being shaped and sized to provide stable support for the stand and said two pivot connections being located with respect to said base, post and clamp to permit the stand to be folded substantially flat for storage or transport thereof and adapted to be pivoted for adjustment of the position of a workpiece over the lap of a user and to hold such position without adjustment of the friction in the connections.

2. A stand as set forth in claim 1 in which said pivot connection of the post to the base is through a U-shaped bracket and includes a bolt disposed through the bracket and the post.

3. A needlecraft stand comprising:

a generally flat base;

a post connected to the base through a friction-type pivot connection near one edge of the base so at least a major portion of said base can fit under a seat, bed or the like;

a clamp for securing a needlecraft frame on the stand mounted on the top of said post through a second friction-type pivot connection;

said two pivot connections have parallel pivot axes for adjustment of the height and lateral position of a needlecraft frame with respect to said base so the height and position of the frame can be easily adjusted over the lap of a seated user who may be in a variety of positions; and said base being shaped and sized to provide stable support for the stand, and said two pivot connections being located with respect to said base, post and clamp to permit the stand to be folded substantially flat for storage or transport thereof and shaped to be pivoted for adjustment of the position of a workpiece over the lap of a user and to hold such position without adjusting the friction in the connections.

4. A stand as set forth in claim 3 which includes a hinge between said clamp and said second pivot connection, and said hinge has a pivot axis parallel to the pivot axes of said pivot connections.

5. A stand as set forth in claim 3 in which said base is symmetrical about a longitudinal axis, said pivot connection of the post to the base is on said axis, and the axes of said pivot connections are transverse to said longitudinal axis of the base.

6. A stand as set forth in claim 3 in which said clamp comprises two elongated jaws disposed parallel to said pivot axes.

* * * * *